US006959159B2

(12) United States Patent
Phillips

(10) Patent No.: US 6,959,159 B2
(45) Date of Patent: Oct. 25, 2005

(54) SYSTEM AND METHODS FOR PROTECTING PRINTER CONSUMABLES THROUGH POSITIONING NON-USE ZONES

(75) Inventor: Quintin T. Phillips, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/695,093

(22) Filed: Oct. 28, 2003

(65) Prior Publication Data

US 2004/0086296 A1 May 6, 2004

Related U.S. Application Data

(62) Division of application No. 09/851,703, filed on May 8, 2001, now Pat. No. 6,666,595.

(51) Int. Cl.[7] ..... G03G 15/00
(52) U.S. Cl. ..... 399/75
(58) Field of Search ..... 399/75, 116, 119, 399/121, 66, 297

(56) References Cited

U.S. PATENT DOCUMENTS 4,875,077 A * 10/1989 Takamatsu et al. ..... 399/114
6,666,595 B2 * 12/2003 Phillips ..... 400/76

FOREIGN PATENT DOCUMENTS

JP 2002258574 A * 9/2002 ..... G03G/15/01

* cited by examiner

*Primary Examiner*—Quana Grainger

(57) ABSTRACT

Sensitive consumable components of printing devices involved in the process of transferring and fixing an image with toner onto a print medium are protected from harmful exposure to the environment and handling through designating and consistently positioning non-use regions of the components toward exposure gaps in their protective housings upon the completion of every printing process. The need for shutter mechanisms on consumable housings to cover up exposure gaps to protect consumables while in a general handling environment is therefore reduced.

14 Claims, 5 Drawing Sheets

SYSTEM AND METHODS FOR PROTECTING PRINTER CONSUMABLES THROUGH POSITIONING NON-USE ZONES

CROSS-REFERENCE TO RELATED APPLICATIONS

The present divisional application claims priority from U.S. patent application Ser. No. 09/851,703 entitled "SYSTEM AND METHODS FOR PROTECTING PRINTER CONSUMABLES THROUGH POSITIONING NON-USE ZONES" filed by Quintin T. Phillips on May 8, 2001 now U.S. Pat. No. 6,666,595, the full disclosure of which is hereby incorporated by reference.

TECHNICAL FIELD

The present invention relates to consumable printer components and, more particularly, to the protection of consumable printer components through positioning designated non-use regions of these components in a manner which protects the remaining usable regions.

BACKGROUND

Printing devices such as printers, copiers, and facsimile machines, have replaceable components with limited life cycles during which the components are functional. When a component's life cycle ends, the component must be replaced. Examples of replaceable printing device components, often referred to as consumables, include paper, toner cartridges, ink cartridges, ribbon cartridges, fusers, photoconductors, drums, intermediate transfer belts, and the like. Consumables such as paper, toner and ink are consumed with each printed page because they make up the printed product. Other consumables such as fusers, photoconductors, and transfer drums or belts, are consumed with each page printed due to deterioration.

These latter consumable types are very sensitive and can be easily damaged through the general handling environment encountered, for example, while being handled during insertion into the printing device. In order to protect these consumables, they are generally enclosed within a cartridge or protective housing. However, their sensitive elements must be exposable to the external environment during the printing process so that they can accept and transfer image information or otherwise fulfill their function as designed within the printing process.

Therefore, the protective housing or cartridge which shields such consumables typically includes a gap through which the sensitive consumable element can be exposed. In order to limit this exposure, a movable protective mechanism such as a shutter is designed to cover the gap during times when the consumable item is not inserted within the printing device. Thus, while the cartridge containing the consumable is outside of the printing device, the protective shutter remains closed. When the cartridge is inserted into the printing device, a mechanism acts to open the shutter, exposing the sensitive consumable element in preparation for the printing process to begin.

Although this method of protecting consumable components works fairly well, the additional material and design costs associated with such shutter mechanisms increases the price consumers must pay to replace the consumable components. Thus, the cost of consumable components significantly increases the overall cost of ownership for printing devices. The use of shutter mechanisms to protect the sensitive consumable components serves to further increase the overall cost of ownership for various printing devices.

Accordingly, the need exists for a cost effective way of protecting sensitive consumable printing elements from harmful exposure in a general handling environment, while permitting the exposure of such elements as necessary to achieve their designed functionality in a printing process environment.

SUMMARY

Sensitive consumable components of printing devices are protected from harmful exposure to the environment and handling damage by designating regions of the components as non-use zones and consistently positioning the non-use zones toward exposure gaps in protective housings of the components during periods when the device is not printing.

Printers include one or more insertable consumable components that each have an image process surface. The consumable components are enclosed in protective housings that have an exposure gap. Printer control logic located either on the printer or on a host computer coupled to the printer, designates a region of the image process surface as a non-use zone. During periods when the printer is not printing, the printer control logic positions the non-use zone toward the exposure gap in the protective housing.

The printer control logic also designates a region of the image process surface as an image zone. During periods of printing, the image process surface translates past an exposure gap in the protective housing that encloses the consumable component. As the process surface translates past the exposure gap, image information is transferred to and from the image zone. The printer control logic operates to avoid transferring image information to a non-use zone during periods of printing.

Positioning the non-use zone of a consumable component toward the exposure gap when printing is complete, protects the image zone portion of the consumable by preventing its contact with the external environment through the exposure gap. The need for shutter mechanisms that cover exposure gaps and shield sensitive consumable elements from the general handling environment is therefore reduced. Reducing or eliminating shutter mechanisms from consumable cartridges or protective housings lowers design and manufacturing costs, thereby reducing the cost of replacing consumable components for printing devices.

BRIEF DESCRIPTION OF THE DRAWINGS

The same reference numbers are used throughout the drawings to reference like components and features.

DETAILED DESCRIPTION

Implementation of zone-protected consumables preserves the sensitive image-transferring capabilities of the consumables while in many cases permitting the elimination of protection mechanisms, such as shutters, that are otherwise necessary to cover exposure gaps in the protective housings of the consumables. Reducing the need for such shutter mechanisms reduces material and design costs associated with consumable print device components.

Exemplary Printer System for Zone-Protected Consumables

Figure 1:
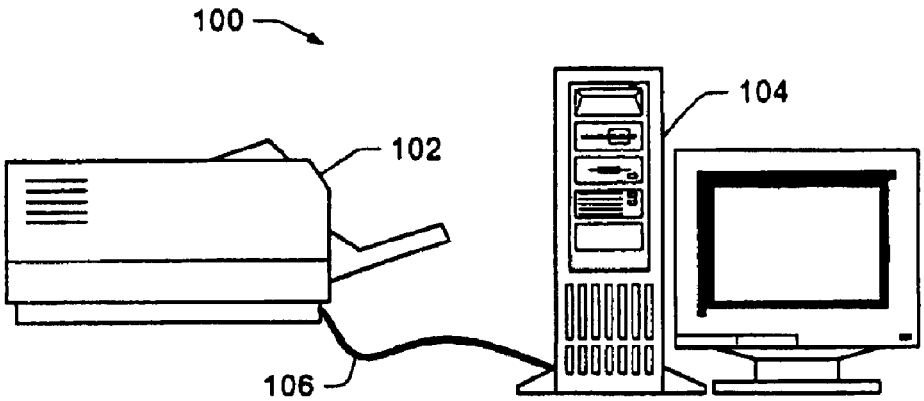
FIG. 1 illustrates a workstation and a printer device as a suitable printer system in which zone-protected consumables may be implemented.

FIG. 1 illustrates an example of a printer system suitable for protecting print device consumables by designating and positioning non-use zones of the consumables. The system 100 of FIG. 1 includes a printer device 102 connected to a host computer 104 through a direct or network connection 106. Network connections 106 can include LANs (local access networks), WANs (wide area networks), or any other suitable communication link. The invention is applicable to various types of printing devices that make use of consumable components lending themselves to the designation and positioning of non-use zones as described herein below. Therefore, printer device 102 can include devices such as copiers, fax machines, scanners, and the like, and may also include multifunction peripheral (MFP) devices which combine the functionality of two or more peripheral devices into a single device.

In general, the host computer 104 outputs host data to the printer device 102 in a driver format suitable for the device 102, such as PCL or postscript. The printer device 102 converts the host data and outputs it onto an appropriate recording media, such as paper or transparencies.

Figure 2:
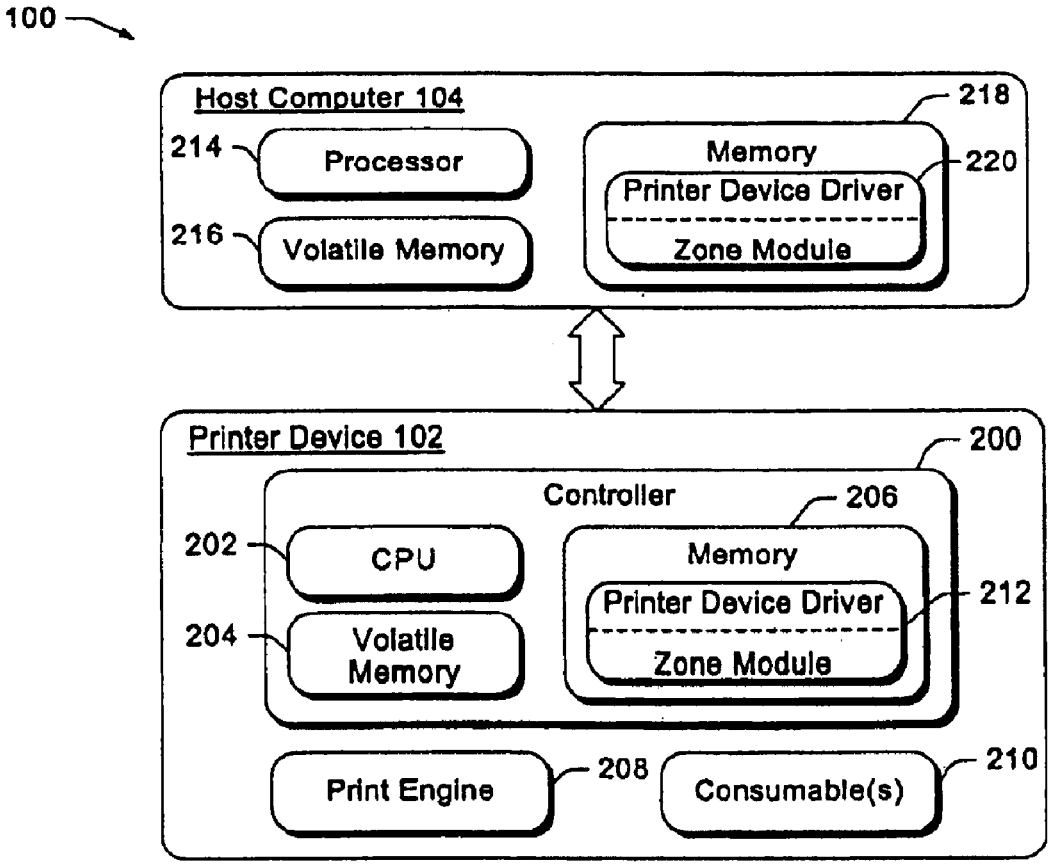
FIG. 2 is a block diagram illustrating a printer system such as that in FIG. 1.

FIG. 2 illustrates the printer system 100 in more detail. The printer device 102 has a controller 200 that processes the host data. The controller 200 typically includes a data processing unit or CPU 202, a volatile memory 204 (i.e., RAM), and a non-volatile memory 206 (e.g., ROM, Flash). The printer device 102 includes a print engine 208 and one or more consumable printing components 210 that are protected through the proper positioning of a designated non-use zone. Consumable(s) 210 represent print device consumables that are consumed due to the wear and tear of the printing process, such as fusers, photoconductors, drums, and intermediate transfer belts. Other typical print device consumables that are consumed in the print process as part of the printed product, such as paper, toner and ink, are not illustrated in FIG. 2.

The controller 200 processes host data and manages the print process by controlling the print engine 208 and consumable(s) 210. Printer control logic controls the print process through a printer device driver 212. The device driver includes printer driver software 212 that is stored in memory 206 and executed on CPU(s) 202. The printer driver software 212 includes a zone module that designates zones on consumables 210 and positions the zones to protect critical regions of the consumables 210, as discussed more thoroughly below.

The host computer 104 includes a processor 214, a volatile memory 216 (i.e., RAM), and a non-volatile memory 218 (e.g., ROM, hard disk, floppy disk, CD-ROM, etc.). The host computer 104 may be implemented, for example, as a general-purpose computer, such as a desktop personal computer, a laptop, a server, and the like. Although the printer device 102 typically stores and executes printer driver software 212 as discussed above, the host computer 104 may additionally implement one or more software-based printer drivers 220 that are stored in non-volatile memory 218 and executed on the processor 214 to configure data into an appropriate format (e.g., PCL, postscript, etc.) and output the formatted data to the printer device 102.

Exemplary Print Process

Figure 3:
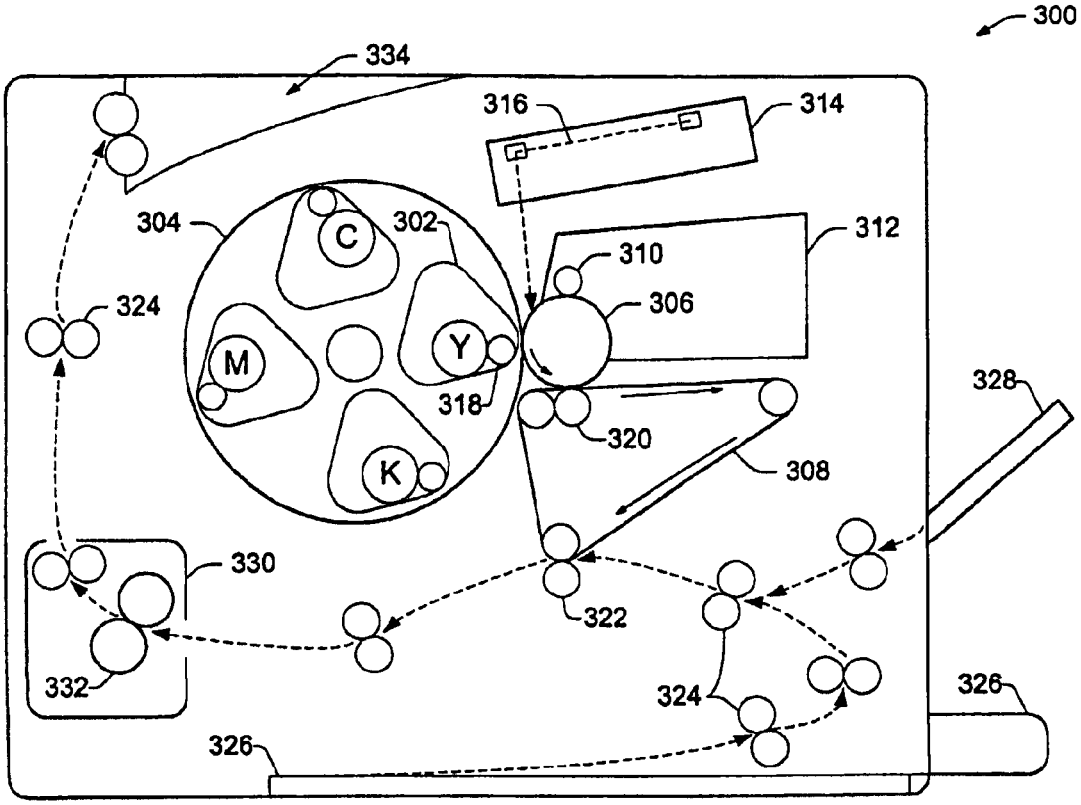
Prior Art Fig. 3
FIG. 3 illustrates a printer device which employs various consumable components.

FIG. 3 represents a color laser printer 300 as an example printer device 102 that may be used in the printing system 100 of FIGS. 1 and 2. A general understanding of the print process that takes place within printing devices such as printer 300 provides an appropriate context for appreciating the various implementations of zone-protected consumables presented below.

A typical color laser printer 300 produces an image using various colored toners. The ultimate application of the toners to a print medium is controlled by an electrostatic imaging process.

Color printer 300 houses four toner cartridges 302 in a rotating carousel 304 that is operational with a single photoconductor (OPC) drum 306. The toner cartridges 302 represent the four main toner colors cyan (C), magenta (M), yellow (Y), and black (K). A four color image is built sequentially onto an intermediate transfer belt (ITB) 308 before it is finally transferred to the print medium (e.g., paper, transparency) in one pass.

To begin the imaging process, a primary charge roller (PCR) 310 within the OPC drum assembly 312 applies an electrostatic charge to the OPC drum 306. As the OPC drum 306 rotates, a laser assembly 314 writes the latent image for the first color onto the drum 306 with laser 316. The toner carousel 304 then puts the first color toner cartridge 302 into position for operation with the OPC drum 306. Within toner cartridge 302, an agitator (not shown) guides toner to a developer roller 318. As the developer roller 318 and OPC drum 306 rotate, the toner is developed to the latent image electrostatically formed on the OPC drum 306.

Each color image is thus developed one at a time on the OPC drum 306. Also, each color image is transferred one at a time to the rotating ITB 308 because of attraction from electric charge on a primary transfer roller 320. Once the four-color image has been built on the ITB 308, the secondary transfer roller 322 is activated to attract the image away from the ITB 308 and onto the paper in one pass of the ITB 308 over the paper. The paper is guided by guide rollers 324 from a paper tray 326 or external source 328 past the ITB 308 and then through the fuser assembly 330. The fuser assembly 330 includes two hot rubber fuser rollers 332 which melt the toner, bonding it to the paper. From the fuser assembly 330, the paper then exits the printer 300 into the output tray 334.

Exemplary Implementations of Zone-Protected Consumables

Figure 4A:
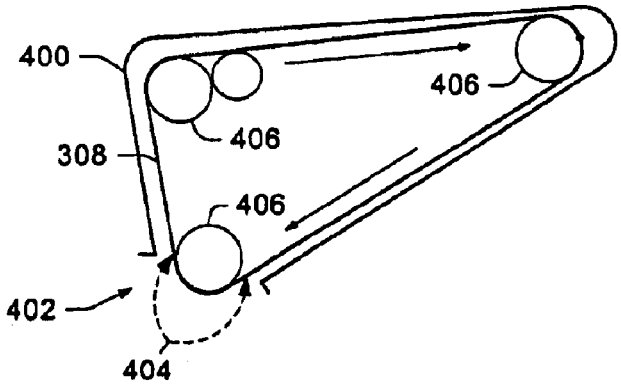
FIG. 4A illustrates an example of a zone-protected intermediate transfer belt to be used in a printer device such as the printer device of FIG. 3.
Figure 4B:
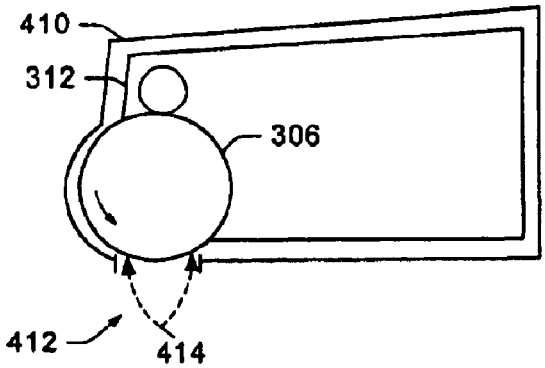
FIG. 4B illustrates an example of a zone-protected photoconductor to be used in a printer device such as the printer device of FIG. 3.
Figure 4C:
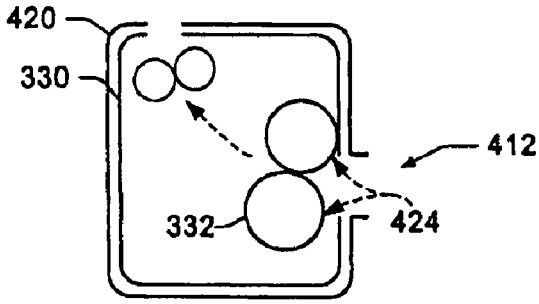
FIG. 4C illustrates an example of the zone-protected fuser assembly to be used in a printer device such as the printer device of FIG. 3.
Figure 5A:
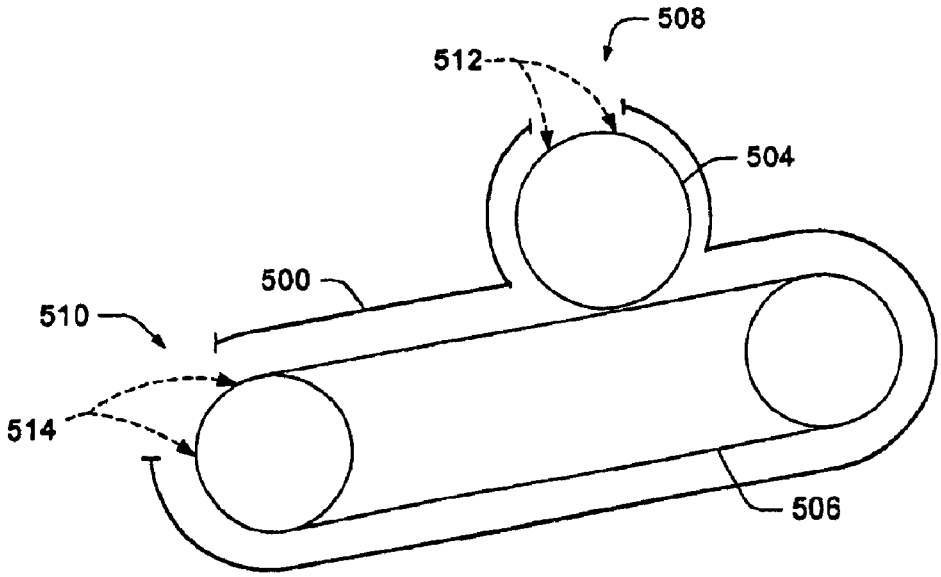
FIGS. 5A and 5B illustrate an example of two zone-protected consumables in a single assembly which includes a photoconductor drum and an intermediate transfer belt.
Figure 5B:
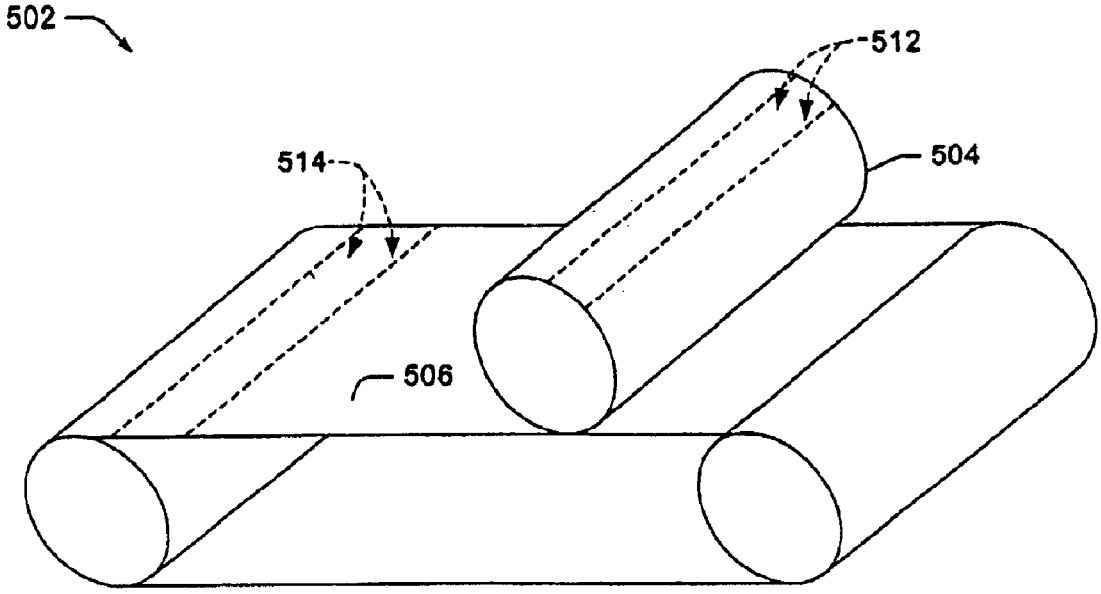

FIGS. 4 and 5 illustrate zone-protected consumable components that can be used in print devices such as the color laser printer 300 of FIG. 3. FIGS. 4A, 4B, and 4C illustrate respectively, an intermediate transfer belt (ITB) 308, a photoconductor drum assembly 312, and a fuser assembly 330, such as those discussed above with respect to the print process of color laser printer 300. FIGS. 5A and 5B illustrate a consumable assembly which includes both a photoconductor drum and an intermediate transfer belt.

Generally, the consumable components of FIGS. 4 and 5 have sensitive image process surfaces that are enclosed within a protective housing such as a cartridge. An image process surface typically covers the surface area of a rotating element within the protective housing. For example, the image process surface may cover the surface area of a rotating cylinder (i.e., a drum), or it may cover the surface area of a belt which rotates around two or more rollers. The protective housing has an exposure gap which permits access to the image process surface during the printing process. The rotating cylinder or belt translates the image process surface with respect to the exposure gap during printing, permitting the transfer of image information to and from the image process surface.

FIGS. 4 and 5 illustrate details regarding the protective housings or cartridges which encase each of the zone-protected consumable components. The elements of the consumable components are enclosed in protective housings which have exposure gaps. As discussed, the exposure gaps facilitate the transfer of image information, such as electrostatic charge, a latent laser image, or a developed toner image, to and from the image process surfaces during printing. However, when consumable components are removed from the print device, the exposure gaps will permit unwanted contact between the sensitive image process surfaces and the external handling environment if the gaps are not covered. Therefore, conventional housings protect the sensitive image process surfaces from the external handling environment through devices such as shutter mechanisms that are designed to cover the exposure gaps.

In FIG. 4A, an intermediate transfer belt (ITB) 308 is enclosed in a protective housing 400. The protective housing 400 has an exposure gap 402 which notably lacks any mechanism for covering the gap 402, such as a shutter mechanism. Thus, a region 404 of the sensitive process surface on the ITB 308 is exposed to the general handling environment when the assembly is removed from the printer device 300. However, in accordance with this implementation, the region 404 has been designated as a non-use zone of the ITB 308. Therefore, this region, or non-use zone 404 of the ITB 308, will not be used during the printing process to transfer image information.

During a printing process, as the ITB 308 rotates around support rollers 406, attracting color images off the OPC drum 306 (FIG. 3), the printing process skips over the non-use zone 404. In addition, during periods of nonprinting the non-use zone 404 of the ITB 308 is positioned at the exposure gap 402. Therefore, although a portion of the sensitive ITB 308 surface is susceptible to damage through the exposure gap 402 during times when the print device is not printing, the remainder of the ITB 308 surface is protected within the protective housing 400. The portion of the ITB 308 surface susceptible to damage is non-use zone 404 that will not be used during the printing process to transfer image information. Only the protected portion of the ITB 308 surface is used as the image zone in a printing process, and the sensitive image transferring function of the ITB 308 is therefore preserved, despite the lack of a shutter mechanism to cover the exposure gap 402.

Printer control logic generally controls the printing process and the designation and positioning of the non-use zone 404. Specifically, printer driver software 212 includes a zone module configured with an inherent understanding of the ITB 308. The driver software 212 designates a non-use zone 404, ensures that the non-use zone 404 is not used in transferring image information during printing periods, and positions the non-use zone 404 at the exposure gap 402 during nonprinting periods. In addition, the printer driver software 212 designates an image zone on the ITB 308 and controls the transfer of image information to and from the image zone during printing. The image zone is typically, but not necessarily, made up of the remaining portion of the ITB 308 that has not been designated as non-use zone 404. Printer driver software 212 is typically stored in memory 206 on the print device 102 (FIGS. 1 and 2), and executes on one or more resident processing units 202. However, the printer driver software 212 may also be stored in memory 218 on a host computer 104 and execute on the host computer processors 214.

With respect to each of the zone-protected consumables of FIGS. 4 and 5, the repeatable positioning of non-use zones and image zones can occur in a variety of ways. For example, a particular position on the consumable can act as a home location which is sensed by a monitoring device on the printer or the consumable. All motions of the consumable and its zones are then coordinated from this home location. Consumables may also be equipped with an electronic memory device which stores the location of the non-use zone. The location of the non-use zone can then be transmitted to the printer upon inserting the consumable into the printer. The printer control logic would therefore designate the location transmitted from the memory device as the non-use zone.

It should be recognized that non-use zones for the zone-protected consumables described herein can be set by the printer, host computer, or at the factory where they are manufactured.

In a second implementation of a zone-protected consumable, FIG. 4B illustrates a photoconductor (OPC) drum assembly 312 enclosed in a protective housing 410. The protective housing 410 has an exposure gap 412 which has no shutter mechanism for covering up the gap 412. As in the case of the ITB 308 of FIG. 4A, a region of the OPC drum 306 has been designated as a non-use zone 414 of the OPC drum 306. Therefore, this non-use zone 414 of the OPC drum 306 will not be used during the printing process to transfer image information. During a printing process, as the OPC drum 306 rotates and receives latent color images written with a laser and developed with toner, the printing process skips over the non-use zone 414. During non printing periods (e.g., at the end of a printing process), the non-use zone 414 of the OPC drum 306 is positioned at the exposure gap 412. Therefore, although a portion of the sensitive OPC drum 306 surface is susceptible to damage through the exposure gap 412 during nonprinting periods, the image zone on the remainder of the OPC drum 306 surface is protected within the protective housing 410, despite the lack of a shutter mechanism to cover the exposure gap 412.

Designation and control of the non-use zone 414 of the OPC drum 306 is handled in the same manner as described above with regard to the ITB 308 of FIG. 4A. That is, printer control logic controls the printing process and the designation and positioning of the non-use zone 414. Printer device driver software 212, including a zone module, is stored and executes on either the printer device 102 or host computer 104. The software 212 selects the non-use zone 414, ensures that only the remaining image zone is utilized during each printing process, and consistently positions the non-use zone 414 at the exposure gap 412 during nonprinting periods, such as when a printing process is completed.

FIG. 4C illustrates a fuser assembly 330 enclosed in a protective housing 420. In many print devices, the hot rubber fuser rollers 332 that melt the toner and bond it to the paper, have small diameters requiring the rollers to complete several full rotations in order to fuse each page. Fuser assemblies designed in this manner are less amenable to the zone-protection described herein, because it is not as feasible to designate a region of the fuser rollers 332 for non-use. However, the invention contemplates fuser assembly designs in which the fuser rollers 332 have adequate diameters to permit designation of non-use zones. For these fuser assembly designs, the designation and control of a non-use zone would be implemented in a manner similar to those described above regarding the ITB 308 of FIG. 4A and the OPC drum 306 of FIG. 4B. Briefly, a non-use zone 424 for each of the fuser rollers 332 is designated and controlled by printer driver software 212 that includes a zone module. The printer driver software 212 is stored and executing on either the printer device 102 or host computer 104, and operates to select the non-use zones 424. The software 212 ensures that the remaining circumference of each fuser roller 332 is used as a fuser zone during each printing process, and consistently positions the non-use zones 424 toward the exposure gap 422 upon the completion of each printing process.

A final implementation of a zone-protected consumable is illustrated in FIGS. 5A and 5B. FIG. 5A shows a multi-consumable component assembly encased in a protective housing 500. The multi-consumable component assembly 502 itself is more clearly illustrated in FIG. 5B. The component assembly 502 includes a photoconductor (OPC) drum 504 and an intermediate transfer belt (ITB) 506. Various print devices are designed to include similar multi-consumable assemblies as such arrangements facilitate the transfer of imaging information between the OPC drum 504 and the ITB 506.

The protective housing 500 of the multi-consumable component assembly 502 has exposure gaps 508 and 510. There are no shutter mechanisms for covering up the gaps when the unit is removed from the print device. For both the OPC drum 504 and the ITB 506, respective regions 512 and 514 have been designated as non-use zones 512 and 514. These non-use zones will not be used during the printing process to transfer image information. Therefore, during a printing process, as the OPC drum 504 rotates to receive latent color images written with a laser and developed with toner through exposure gap 508, the printing process skips over non-use zone 512. Likewise, as the printing process transfers image information from the OPC drum 504 to the ITB 506, the process skips over non-use zone 514 on the ITB 506. When images are transferred from the ITB 506 to paper through exposure gap 510, non-use zone 514 is also not involved, as it contains no image information.

At the completion of each printing process, non-use zones 512 and 514 are both positioned at respective exposure gaps 508 and 510. Therefore, the image zones on the OPC drum 504 and the ITB 506 are always protected within the protective housing 500, despite the lack of a shutter mechanisms to cover exposure gaps 508 and 510.

Designation and control of non-use zones 512 and 514 is handled in the same manner as described above with regard to the ITB 308 of FIG. 4A. That is, printer control logic controls the printing process and the designation and positioning of non-use zones 512 and 514. Printer driver software 212, including a zone module, is stored and executes on either the printer device 102 or host computer 104. The software 212 selects the non-use zones 512 and 514, ensures that only the remaining image zones on the OPC drum 504 and the ITB 506 are utilized during each printing process, and consistently positions the non-use zones 512 and 514 at respective exposure gaps 508 and 510 upon the completion of each printing process.

In addition to specifically illustrating how designating and controlling non-use zones can protect an OPC drum and ITB single assembly consumable, FIG. 5 and its description are also intended to illustrate that the invention is more broadly applicable to various multi-consumable component assembly devices. Furthermore, concepts disclosed herein regarding positioning non-use zones to protect the sensitive transfer elements of print device consumables are not limited in application to the described implementations. Rather, these concepts are applicable to any critical imaging component which has sufficient imaging region to permit designation of a non-use zone to be controlled in a manner as described above for the purpose of protecting the remaining imaging region of the component.

Exemplary Print Process Using Zone-Protected Consumables

Having introduced several example print device consumables which can be protected by positioning non-use zones toward exposure gaps in their protective housings, a general print process will be illustrated using such zone-protected consumables. The process described is very general, and only intended to illustrate how zone-protected consumables are used within an otherwise conventional print process such as that described above with regard to the color laser printer 300 of FIG. 3.

Figure 6:
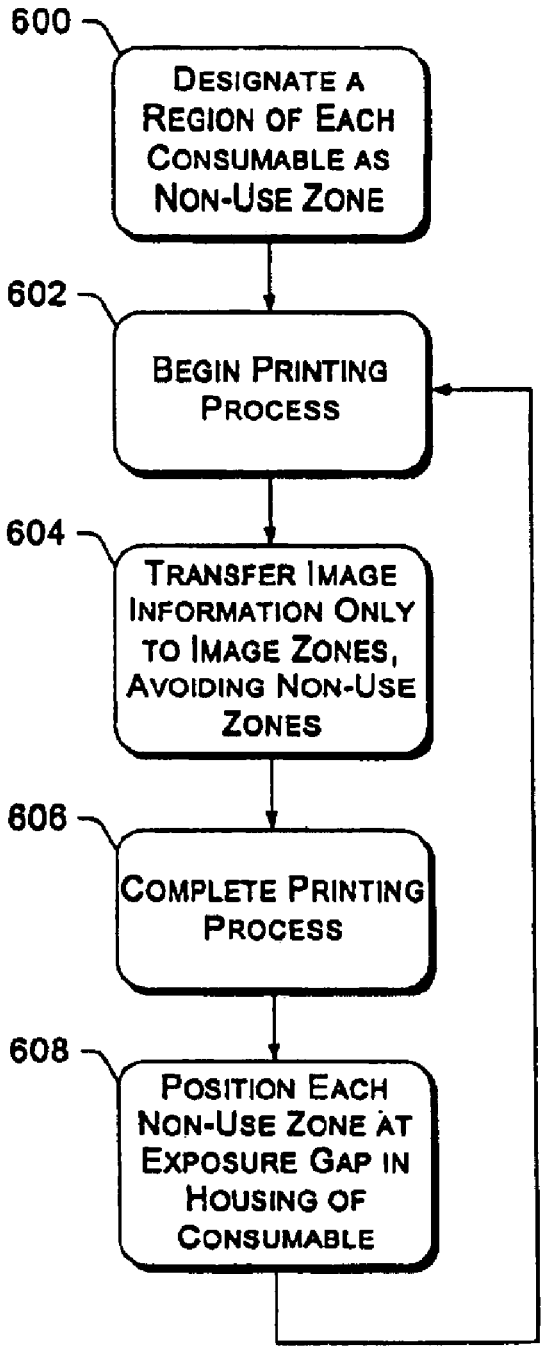
FIG. 6 is a flow diagram illustrating an example method of protecting a consumable through designating and positioning a non-use zone.

FIG. 6 is a flow diagram illustrating the general use of zone-protected consumables in a print device. Prior to the start of a printing process, non-use zones are defined or designated on each consumable that has an image transfer region capable of sacrificing a portion of this region to non-use. The designation of these non-use zones is illustrated by operation 600. A printing process then begins at operation 602. The printing process is controlled such that image information is transferred only to areas of image transfer regions on each consumable that have not been designated as non-use zones. These areas are the image zones for each consumable. The transfer of image information is shown at operation 604. The printing process is completed at operation 606. This indicates that a page or a number of pages from a print job have been output onto a print medium such as paper or a transparency. After a printing process is completed, each non-use zone is positioned toward the exposure gap in the protective housing that encases each consumable, as illustrated by operation 608. Although there is no shutter mechanism covering the exposure gaps, the positioning of the non-use zones protects the image zones of each consumable. This is especially important if the consumable is removed from the print device between print processes. For subsequent print processes, the non-use zones have already been defined and are therefore not designated again. Therefore, subsequent processes start at operation 602. This ensures that once an area of a consumable is designated as a non-use zone, it remains a non-use zone which is consistently positioned at an exposure gap following a print process to protect the consumable.

Although the description above uses language that is specific to structural features and/or methodological acts, it is to be understood that the invention defined in the appended claims is not limited to the specific features or acts described. Rather, the specific features and acts are disclosed as exemplary forms of implementing the invention.

What is claimed is:

1. A method of printing using a print device, the print device comprising a first consumable having a first a process surface, a second consumable having a second process surface and at least one protective housing having a first exposure gap and a second exposure gap, the method comprising:

designating a region of the first process surface as a first non-use zone;

designating a region of the second process surface as a second non-use zone;

avoiding the transfer of image information to the first non-use zone and the second non-use zone during periods of printing; and positioning the first non-use zone at the first exposure gap and the second non-use zone at the second exposure gap during periods of nonprinting.

2. The method as recited in claim 1, further comprising:

designating a region of the first process surface as an image zone; and controlling the first process surface to facilitate the transfer of image information to and from the image zone during periods of printing.

3. Computer-readable media having computer-readable instructions for performing the method as recited in claim 1.

4. The method of claim 1, wherein the first consumable comprises a photoconductor and wherein the second consumable comprises a non-photoconductive printing material transfer member.

5. The method of claim 4, wherein the second consumable comprises a belt.

6. The method of claim 1, wherein the first consumable comprises a photoconductor and wherein the method further includes applying printing material to the photoconductor through the first exposure gap.

7. A method for protecting a photoconductor of a printing device, the photoconductor encased within a protective housing having an exposure gap, the method comprising:

defining a region of the photoconductor as an image zone;

forming an image on the image zone by exposing the image zone to a photoelectric imaging process and dusting the image zone with toner through the exposure gap;

defining a region of the photoconductor as a non-use zone;

positioning the non-use zone at the exposure gap during periods of nonprinting.

8. The method as recited in claim 7 further comprising:

avoiding the transfer of image information to the non-use zone during periods of printing.

9. The method as recited in claim 7, further comprising:

avoiding the transfer of image information to the non-use zone during periods of printing.

10. Computer-readable media having computer-readable instructions for performing the method as recited in claim 7.

11. A method for printing comprising:

designating a region of a non-photoconductive consumable, contained within a protective housing having a first exposure gap, as a non-use zone; and positioning the non-use zone at the first exposure gap during periods of non-printing.

12. The method of claim 11, wherein the non-photoconductive consumable includes a first roller and a second opposite roller and wherein the non-use zone includes a first portion of the first roller and a second portion of the second roller.

13. The method of claim 11, wherein the non-photoconductive consumable comprises printing material transfer member and wherein the method further includes depositing printing material upon the transfer member while avoiding the deposition of printing material on the non-use zone during periods of printing.

14. The method of claim 11 including:

designating a region of a photoconductor within the protective housing as an image-zone;

designating a region of the photoconductor as a non-use zone;

depositing the printing material to the photoconductor through a second exposure gap in the protective housing; and positioning the non-use zone of the photoconductor at the second exposure gap during periods of nonprinting.

* * * * *

UNITED STATES PATENT AND TRADEMARK OFFICE

CERTIFICATE OF CORRECTION

PATENT NO. : 6,959,159 B2
APPLICATION NO. : 10/695093
DATED : October 25, 2005
INVENTOR(S) : Quintin T. Phillips et al.

It is certified that error appears in the above-identified patent and that said Letters Patent is hereby corrected as shown below:

IN THE CLAIMS

Column 8, Claim 1, line 61, after "first" delete "a"

Signed and Sealed this

Twenty-sixth Day of June, 2007

JON W. DUDAS
*Director of the United States Patent and Trademark Office*